US005240256A

United States Patent [19]

Hartman

[11] Patent Number: 5,240,256

[45] Date of Patent: Aug. 31, 1993

[54] TETHERED BALL AND RECEPTACLE TOY WITH REVOLVING FRAME

[76] Inventor: Richard B. Hartman, 7516 201st SE., Issaquah, Wash. 98027

[21] Appl. No.: 939,096

[22] Filed: Sep. 2, 1992

[51] Int. Cl.[5] ..... A63B 67/10

[52] U.S. Cl. ..... 273/320; 273/329; 273/330

[58] Field of Search ..... 273/320, 321, 329, 330, 273/331, 335, 413, 414, 58 C

[56] References Cited

U.S. PATENT DOCUMENTS

| | | | |
|---|---|---|---|
| 820,017 | 5/1906 | Russell | 273/321 |
| 1,294,472 | 2/1919 | Kershaw | 273/320 |
| 1,954,469 | 5/1934 | Gregory | 273/329 X |
| 2,414,063 | 1/1947 | Rogers | 273/329 |
| 2,442,296 | 5/1948 | Lang | 273/320 |
| 2,566,044 | 8/1951 | Trepanier | 273/330 |
| 3,038,724 | 6/1962 | Klamp | 273/329 |
| 3,108,807 | 10/1963 | Ruehle | 273/325 |
| 3,313,542 | 4/1967 | Johnston | 273/320 |
| 3,494,618 | 2/1970 | Kramer | 273/320 |
| 3,606,322 | 9/1971 | Kersch | 272/320 |
| 3,721,441 | 3/1973 | Wininger | 273/330 |
| 4,039,186 | 8/1977 | Anderson | 273/329 |
| 4,300,771 | 11/1981 | Lori | 273/329 |
| 4,375,890 | 3/1983 | Thomas | 273/320 |

OTHER PUBLICATIONS

*American Folk Toys—How to Make Them,* By Dick Schnacke Jan, 1973, pp. 20–21.

*Toys & Games—The Smithsonian Illustrated Library of Antiques,* prepared by the Cooper-Hewitt Museum Jan. 1981, pp. 14–15.

*Primary Examiner*—William H. Grieb

[57] ABSTRACT

Tethered ball and receptacle toy incorporating a tethered ball, one or more catcher loops, and a revolving frame adapted to be spun in relation to one or more rotating handles. Revolving frame (20) includes rod (22), catcher loops (48), handle mounts (24) and tether anchor (37). Catcher loops (48) incorporate an aperture (50) just large enough to receive ball (46) in a nested fashion. Handle mounts (24) include handle receiving holes (34) which receive rotating handles (26) with grip (28), axle (30), and hub (32).

9 Claims, 5 Drawing Sheets

TETHERED BALL AND RECEPTACLE TOY WITH REVOLVING FRAME

BACKGROUND

1. Field of Invention

This invention relates to skill toys, specifically, a tethered ball and receptacle device incorporating a revolving frame, rotating handles and multiple catcher loops for launching and receiving a tethered ball.

2. Discussion of Prior Art

Tethered ball and receptacle toys, sometimes known as "ball and cup" toys, have been popular in many cultures throughout history. Sixteenth-century French drawings depict groups of children and adults playing with a toy consisting of a ball attached by a cord to a handle with a cuplike ending. The basic object of such toys was, presumably, to throw the ball into the air and attempt to catch it in the receptacle portion of the toy. Toy historians believe the origins of such toys to be even older.

Modern variations of tethered ball and receptacle toys have incorporated multiple receptacles mounted on integrally formed frame-and-handle assemblies. U.S. Pat. No. 2,442,296 to Lang (1948), for example, discloses a game device in which a thumb-operated springboard attached to a hand-held frame with integrally joined handle is used to project a tethered ball back and forth between two cup-shaped receptacles on the toy. U.S. Pat. No. 3,313,542 to Johnston (1967) shows an orbiting ball game with an integrally joined frame-and-handle assembly with two cuplike receptacles, designed to simulate the flight paths of a missile in space. U.S. Pat. No. 3,108,807 to Ruehle (1963) discloses an untethered ball game device in which a player manipulates two handles integrally joined to a rod-shaped frame in order to toss a ball back and forth between two cup-shaped receptacles.

These prior art examples suffer from a number of common disadvantages, a prime disadvantage being the stationary relationship that exists between the frame of each toy and its handle. This fixed relationship limits the variety of shots or tricks which are possible using each toy, and thereby diminishes each toy's potential for lasting fun and amusement, qualities jointly referred to in the toy industry as "play value."

Specifically, Lang's toy has but one object—that of getting a ball to spring back and forth between two cup-shaped receptacles while grasping a handle fixedly joined to the frame of the toy. Failure to master this extremely specialized maneuver can easily frustrate players, especially young children or adults lacking adequate hand-eye coordination. Conversely, a player who is able to master the solitary trick inherent in Lang's toy is no longer challenged by the device and is apt to lose interest in it.

Johnston's toy also discloses a single handle fixedly joined to the toy's frame. This configuration permits a similarly narrow range of tricks, and requires an even more complicated, intricately timed series of hand maneuvers in order for a player to achieve a successful result.

Ruehle's invention attempted to improve upon the play value of ball and receptacle toys by including two handles fixedly joined to a rod-shaped frame. This permits a player to employ both hands to guide a ball back and forth between two cup-shaped receptacles on the toy. However, the fixed position of the handles in relation to the frame of Ruehle's invention still limits a player to one or two very basic tricks. Furthermore, Ruehle's invention lacks a tethering device for connecting the ball to the frame of the toy. This could lead to the frustrating inconvenience of having the ball fly or roll away from the player and possibly become lost. The fixed handles and lack of a tethering device in Ruehle's toy also prohibit numerous unique methods of play inherent in the present invention, as will become apparent in the discussion to follow.

In addition to the above-mentioned disadvantages, none of the prior art inventions cited above anticipates a tethered ball and receptacle toy in which the frame of the toy can be revolved freely in relation to one or more rotating handles, thereby increasing the versatility and play value of the toy and producing many unexpected physical, visual and auditory results. In addition, none of the prior art inventions cited above anticipates a skill toy in this category utilizing substantially loop-shaped receptacles or catcher loops, both sides of which can nestably receive a tethered ball and which are less costly to produce than traditional cup-shaped receptacles. Finally, none of the prior art inventions cited above anticipates a structure in which the frame of the toy is constructed in such a way as to form a single, elongated track upon which a tethered ball can be rolled or launched back and forth by means of manipulating one or more rotating handles.

Therefore, it can be seen that there remains a need for a tethered ball and receptacle toy incorporating a revolving frame, rotating handles and catcher loops that enables a player to operate the toy in a multitude of ways previously unanticipated; that provides for a variety of difficulty levels enabling players of various ages and skill levels to experience success and yet continue to be challenged and intrigued by the toy; that permits a configuration in which the frame of the toy forms a single, elongated track upon which a tethered ball can be rolled or launched back and forth by manipulating one or more rotating handles; and which is relatively simple and inexpensive to produce.

OBJECTS AND ADVANTAGES

Accordingly, the objects and advantages of my invention are to provide a tethered ball and receptacle toy:

(a) that incorporates a revolving frame;

(b) that includes rotating handles upon which the revolving frame of the toy can spin, thereby providing for a greater variety of tricks and stunts than are possible under previous disclosures in this category;

(c) that utilizes catcher loops, both sides of which can nestably receive a tethered ball and which are less costly to produce than traditional cup-shaped receptacles;

(d) that provides an inviting and enjoyable source of recreation and entertainment for players at a wide range of ages and skill levels;

(e) that permits a configuration in which the frame of the toy forms an elongated track upon which a tethered ball can be rolled or launched back and forth by manipulating one or more rotating handles; and (f) which is relatively simple and inexpensive to produce.

Further objects and advantages of my invention will become apparent from a consideration of the drawings and ensuing description of it.

REFERENCE NUMERALS IN DRAWINGS

| | | | |
|---|---|---|---|
| 20 | revolving frame | 22 | rod |
| 24 | handle mount | 26 | rotating handle |
| 28 | grip | 30 | axle |
| 32 | hub | 34 | handle receiving hole |
| 36 | gap | 37 | tether anchor |
| 38 | tether anchor rod | 40 | tether hole |
| 42 | tether | 44 | knot |
| 46 | ball | 48 | catcher loop |
| 50 | aperture | 52 | track |

DESCRIPTION—FIGS. 1, 2, 3, 4, 5, 6, 7, 8, 9, 10

Figure 1:
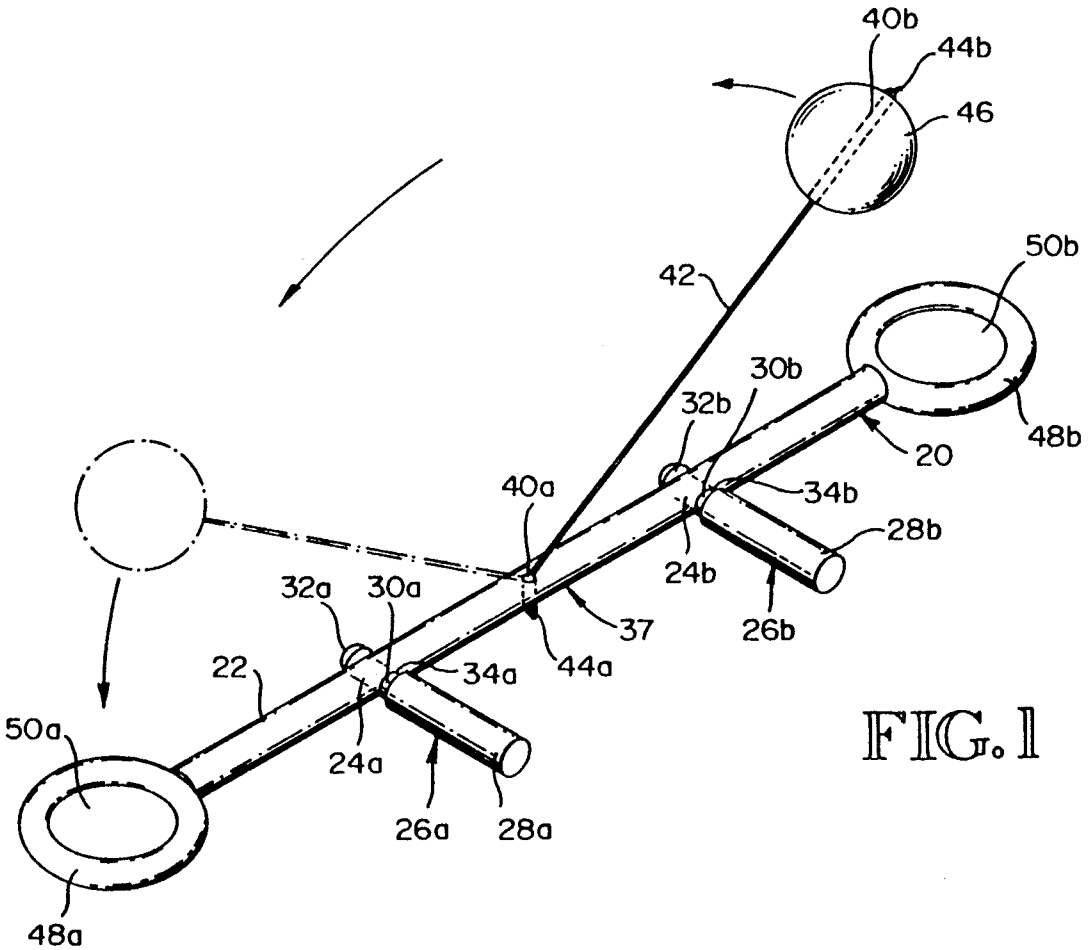
FIG. 1 is a perspective view of a tethered ball and receptacle toy incorporating a revolving frame, rotating handles and catcher loops in accordance with the present invention, with movements of a basic trick indicated in dotted lines.

FIG. 1 shows a view of a basic version of my invention. A revolving frame 20 is comprised of a rod 22, handle mounts 24a and 24b, catcher loops 48a and 48b, and tether anchor 37. Handle mounts 24a and 24b in this embodiment are equidistantly spaced on opposite sides of the midpoint of rod 22 and consist of handle receiving holes 34a and 34b, which are integrally formed within rod 22. Two rotating handles 26a and 26b are engaged by handle mounts 24a and 24b, respectively. Each rotating handle 26 consists of a grip 28, an axle 30 and a hub 32. Catcher loops 48a and 48b include apertures 50a and 50b, respectively, and are secured at opposite ends of rods 22 in a plane parallel to that of grips 28a and 28b. One end of a tether 42 is secured to tether anchor 37 by passing through a tether hole 40a in tether anchor 37 and terminating in a knot 44a. The opposite end of tether 42 is secured to a ball 46 by passing through a tether hole 40b in ball 46 and terminating in a knot 44b.

With the exception of tether 42, each physical component described above may be crafted in wood, metal, plastic, rubber, foam or any other material sufficiently rigid to withstand the operational stresses of the toy. Rod 22 and catcher loops 48a and 48b may be molded together in one piece or crafted separately and later firmly joined by means of a snap-type device, glues or other standard fasteners. Similarly, grips 28, axles 30 and hubs 32 of rotating handles 26 may be molded in one piece or separately molded and later joined.

Tether 42 may be elastic or inelastic, and may consist of any material such as cotton, nylon, rubber, plastic or any other durable filament. Tether 42 is of such length as to just permit ball 46 to reach and become nested in either catcher loops 48a or 48b. When ball 46 does become nested in this manner, tether 42 is taut. Catcher loops 48a and 48b are of such diameter as to just permit ball 46 to become nested in apertures 50a and 50b without allowing ball 46 to pass completely through catcher loops 48a or 48b.

The diameter of handle receiving holes 34a and 34b should be only slightly larger than the diameter of axles 30a and 30b so as to permit rotating handles 26a and 26b to spin freely while preventing "wobbling." Rotating handles 26a and 26b should generally stay oriented in a line perpendicular to that of rod 22. The movements of a basic trick are indicated in dotted lines in FIG. 1.

Figure 2:
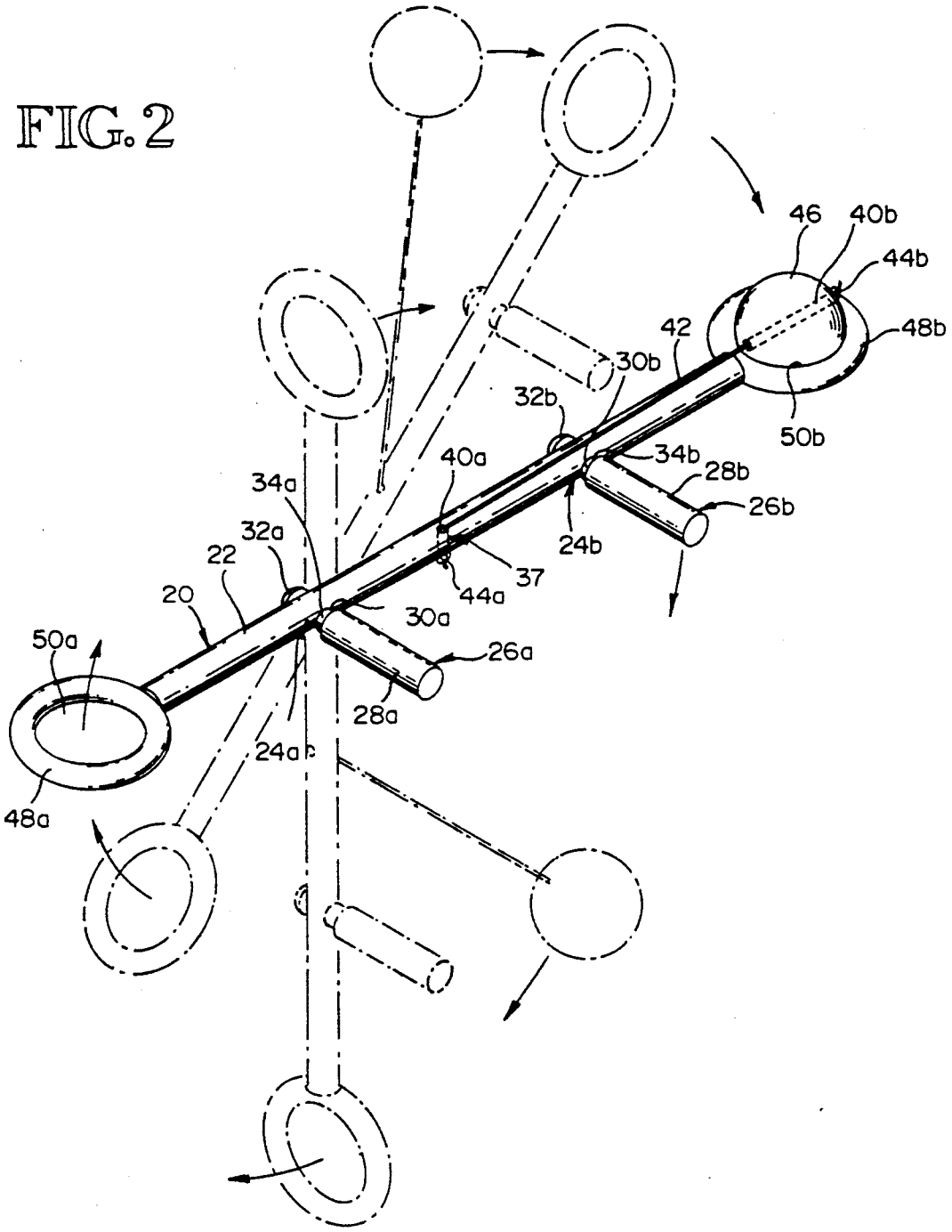
FIG. 2 is another perspective view of the toy of FIG. 1, with the movements of a more complicated trick indicated in dotted lines.

FIG. 2 is another view of the toy depicted in FIG. 1, with the movements of a more complicated trick shown in dotted lines.

Figure 3:
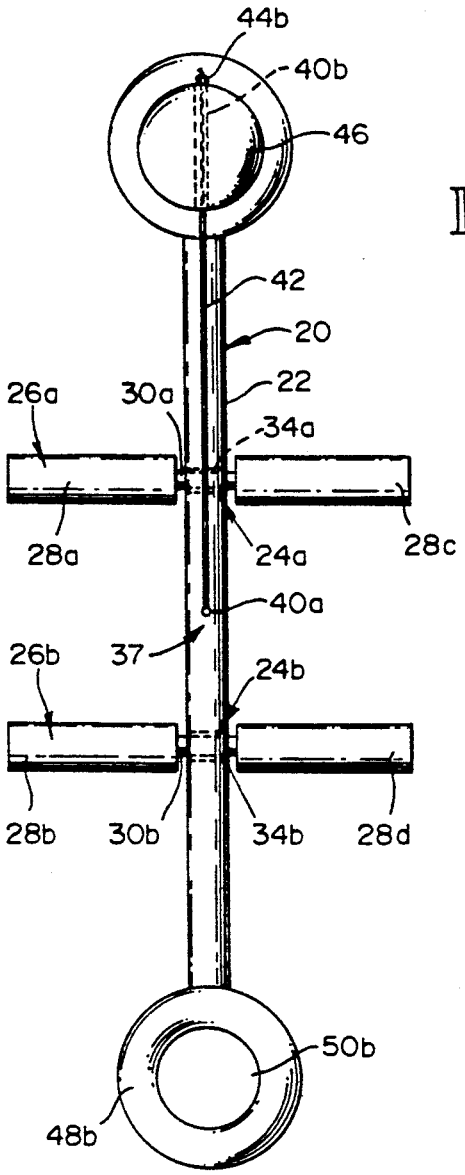
FIG. 3 is a top view of one particular embodiment of the present invention in which additional grips have been added to the rotating handles in order to increase the number of handholds on the toy.

FIG. 3 shows another embodiment of the present invention in which hubs 32a and 32b are replaced by additional grips 28c and 28d, creating a tethered ball and receptacle toy with four handholds.

Figure 4:
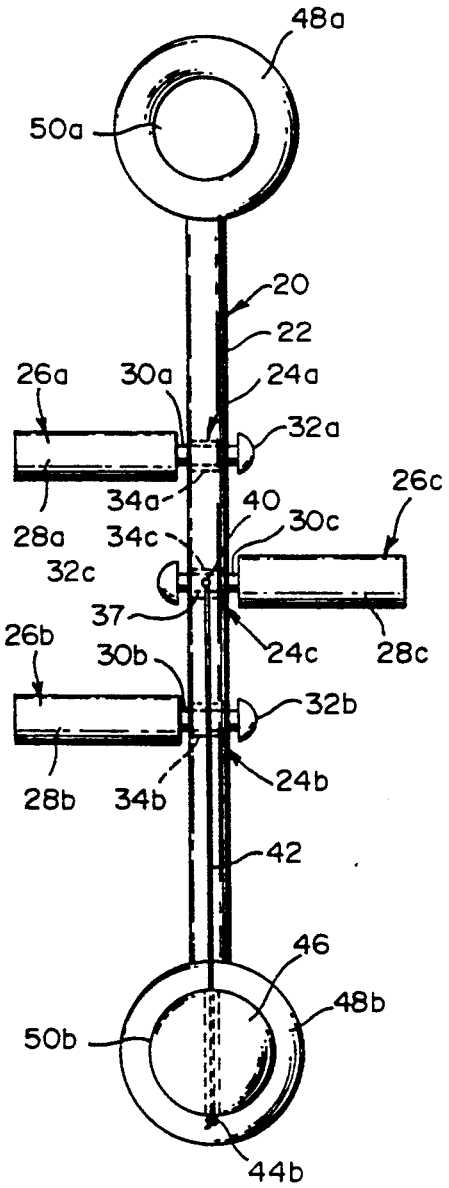
FIG. 4 shows a top view of another embodiment of the present invention in which a third rotating handle has been added to the revolving frame of the toy so as to increase the number of pivot points and handholds of the toy.

FIG. 4 shows another embodiment of the present invention in which a third handle mount 24c and rotating handle 26c have been added to the midpoint of rod 22 so as to increase the number of pivot points of the toy from two to three.

Figure 5:
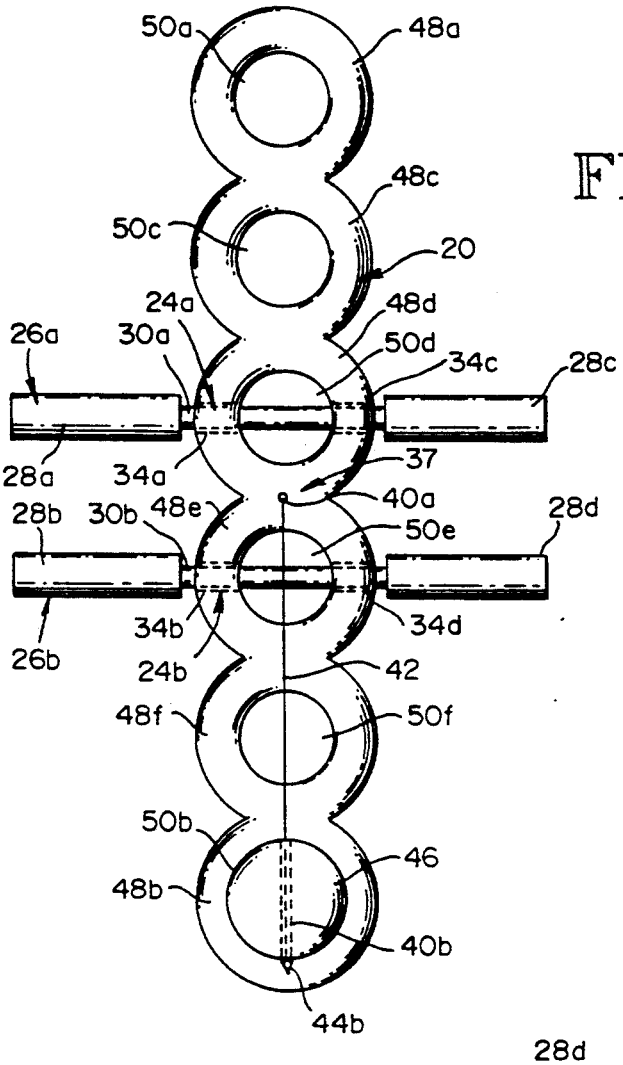
FIG. 5 is a top view of another embodiment of the present invention in which more than two catcher loops are linked to form the revolving frame of a tethered ball and receptacle toy with rotating handles in accordance with the present invention.

FIG. 5 is a top view of another embodiment of the present invention in which additional catcher loops 48c, 48d, 48e and 48f are linked with catcher loops 48a and 48b to form revolving frame 20 of a tethered ball and receptacle toy with rotating handles. Axles 30a and 30b in this embodiment are elongated so as to be engageable with additional handle receiving holes 34c and 34d required to stabilize grips 28a, 28b, 28c and 28d of rotating handles 26a and 26b.

Figure 6:
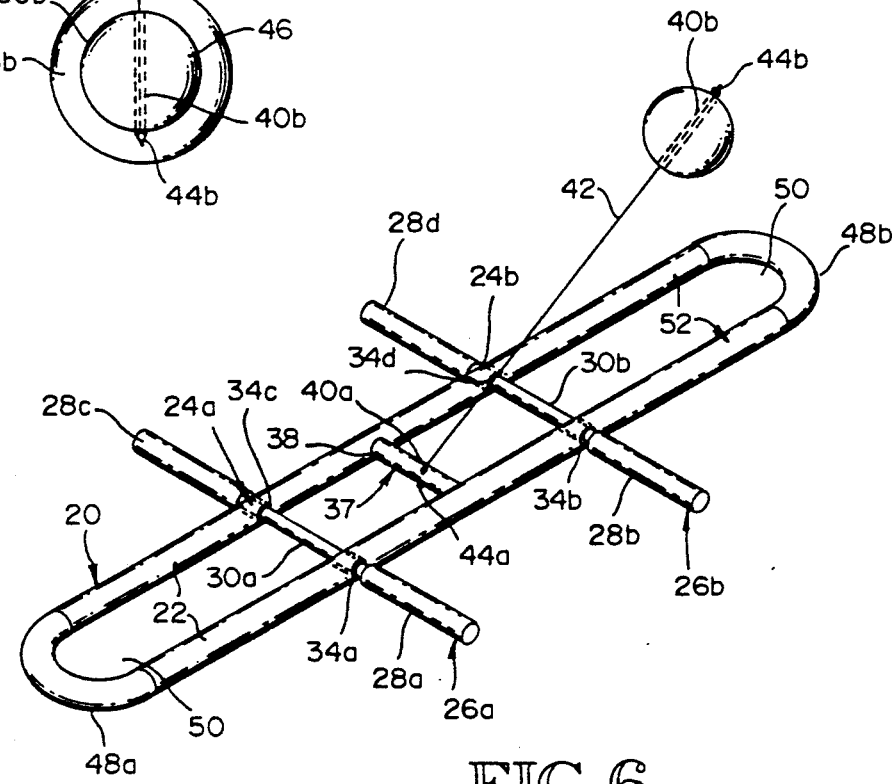
FIG. 6 shows another embodiment of the present invention in which the revolving frame of the toy is configured to form a single, elongated track upon which a tethered ball can be rolled or launched back and forth by manipulating one or more rotating handles.

FIG. 6 shows another embodiment of the present invention in which the revolving frame 20 of the toy forms an elongated track 52 along which ball 46 can become nested and rolled back and forth or launched between catcher loops 48a and 48b. Catcher loops 48a and 48b are semicircular in this embodiment in order to receive rods 22a and 22b, which are spaced in parallel and substantially comprise track 52. In this version of the toy, tether anchor 37 includes a tether anchor rod 38 and tether hole 40a. Elongated axles 30a and 30b and additional handle receiving holes 34c and 34d are also included in this embodiment.

Figure 7:
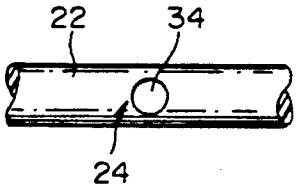
FIG. 7 is an enlarged view of a handle mount of the present invention that permits a rotating handle of the toy to rotate freely.
Figure 8:
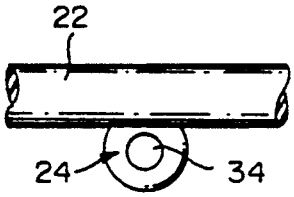
FIG. 8 is an enlarged view of yet another embodiment of a handle mount for receiving freely rotating handles in accordance with the present invention.
Figure 9:
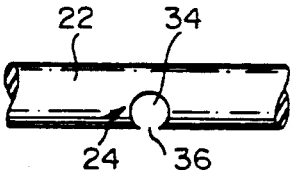
FIG. 9 is an enlarged view of another handle mount for the present invention incorporating a partially open handle receiving hole with a gap for simplified installation and removal of rotating handles.
Figure 10:
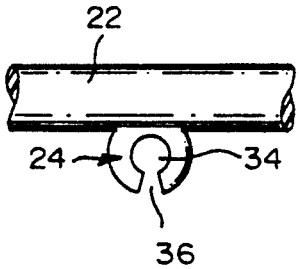
FIG. 10 is an enlarged view of yet another possible handle mount which allows for simple installation and removal of rotating handles.

FIGS. 7, 8, 9, and 10 show enlarged views of some of the means by which handle mounts 24 may be configured. FIGS. 7 and 9 show a handle mount 34 which is integrally formed within rod 22. FIGS. 8 and 10 show a handle mount 34 which protrudes from beneath rod 22. FIGS. 7 and 8 show a fully enclosed handle receiving hole 34. FIGS. 9 and 10 show a partially open handle receiving hole 34 with gap 36 for simplified installation of rotating handles 26.

From the description above, a number of advantages of my invention become evident:

(a) A revolving frame and rotating handles permit a player to manipulate the catcher loops of my invention in ways previously unanticipated, thereby allowing for wholly new forms of play involving the interaction of the revolving frame, catcher loops, rotating handles and tethered ball of the toy, all of which can be spun, looped and twirled in exciting new ways.

(b) Catcher loops are simpler and less costly to produce than conventional cup-shaped receptacles and have the added advantage of being able to nestably receive a tethered ball from both sides, thereby further increasing the versatility of the toy.

(c) The combination of a revolving frame, rotating handles and catcher loops creates novel methods of play for a tethered ball and receptacle toy that present players with a wide range of challenges, from simple tricks to sophisticated stunts and routines.

(d) Multiple rotating handles allow the revolving frame of my toy to spin upon selectively chosen pivot points, thereby enhancing the possible variations of play inherent in the toy and creating interesting and unexpected physical, visual and auditory effects.

(e) The invention permits configurations which include more than two receptacles, thereby further expanding the range of possible tricks inherent in the toy.

(f) The invention also permits a configuration in which the revolving frame of the toy forms a track in which a tethered ball can be rolled or launched from one extremity of the toy to the other by means of manipulating the rotating handles. This rolling effect is extremely simple to produce and yet creates brand new opportunities for advanced tricks and trick combinations.

(g) The materials used in my invention are common and readily available and my design is relatively simple, easy to assemble and inexpensive to produce.

OPERATION—FIGS. 1, 2, 3, 4, 5, 6, 7, 8, 9, 10

To operate the embodiment of my invention shown in FIG. 1, a player begins by grasping grips 28*a* and 28*b* firmly in his or her left and right hands, respectively, while ball 46 rests in catcher loop 48*b*. To perform the basic trick depicted in FIG. 1, the player exerts a short, upward thrust with his or her right hand. The inertial force created by this action causes ball 46 to fly up in an arc-like path and land in catcher loop 48*a*—that is, if the player has applied the correct amount of thrust and has held grips 28*a* and 28*b* relatively parallel with the floor. Tether 42, tether anchor 37 and knots 44*a* and 44*b* serve to anchor ball 46 to rod 22, thereby preventing ball 46 from flying out and away from revolving frame 20. A player needs to hold grips 28*a* and 28*b* firmly throughout this basic trick. In doing so, any torque applied to grips 28*a* and 28*b* is transferred to axles 30*a* and 30*b* which rotate freely within handle receiving holes 34*a* and 34*b*. Hubs 32*a* and 32*b* prevent axles 30*a* and 30*b* from sliding out of handle receiving holes 34*a* and 34*b*. Once a player catches ball 46 in cather loop 48*a*, the process can be reversed with a quick, upward thrust of the left hand which causes ball 46 to fly up and land back in catcher loop 48*b*. This simple trick may be repeated many times and can produce pleasing "clicking" sounds as ball 46 alternately lands in and is launched from catcher loops 48*a* and 48*b*.

A more advanced trick is illustrated in FIG. 2 and begins with the same starting position described above—grips 28*a* and 28*b* are grasped firmly, with ball 46 resting in catcher loop 48*b*. In this trick, a player quickly and firmly thrusts grip 28*b* in a downward direction and releases it—while continuing to hold grip 28*a* with his or her left hand. The inertial forces created by the downward thrust and subsequent release of grip 28*b* causes revolving frame 20 to spin quickly in a clockwise direction around axle 30*a* of rotating handle 26*a*. Simultaneously, ball 46 first drops downwardly, then swings in a clockwise arc following the path of catcher loop 48*b*. By intercepting and again taking hold of grip 28*b* with his or her right hand after one complete revolution of revolving frame 20, a player can bring revolving frame 20 to rest. Ball 46 will land back in catcher loop 48*b* with a pleasing, "clicking" sound—assuming the player has applied the correct timing, accuracy and finesse required of this trick. Literally dozens or other tricks involving thrusting and or releasing rotating handles 26*a* and 26*b* are possible given the embodiment depicted in FIGS. 1 and 2.

Operation of the embodiment of my invention shown in FIG. 3 is similar, although additional grips 28*c* and 28*d* permit even more variations of play. In one such variation, the player grasps grip 28*a* in his or her left hand and grip 28*b* in his or her right hand, holding the toy so that rod 22 lies in a front-to-back orientation rather than the side-to-side orientation depicted in FIGS. 1 and 2. By alternately thrusting his or her left and right hands upwardly, the player can cause ball 46 to fly back and forth between catcher loops 48*a* and 48*b* in a front-to-back path. A more challenging variation based on the same hand positions involves the player spinning revolving frame 20 of the toy end over end by moving his or her hands in a vertical, circular path, as if to "crank" grips 28*a* and 28*b*. The object of such a maneuver is, of course, to successfully land ball 46 in catcher loop 48*a* or 48*b* whenever revolving frame 20 comes to rest. In addition to these variations for one player, additional grips 28*c* and 28*d* may be grasped by a second player, thereby facilitating team-style play of the toy.

Operation of the embodiment of my invention shown in FIG. 4 is similar to the operations described for FIGS. 1,2, and 3, however the placement of additional handle mount 24*c* and rotating handle 26*c* at the midpoint of rod 22 permits a player to spin revolving frame 20 around a centralized axle 30*c* rather than the off-center axles 30*a* and 30*b* of rotating handles 26*a* and 26*b*. In one particular method of operation of this embodiment, the player grasps grip 28*c* (with grips 28*a* and 28*b* pointing away from the player) and spins revolving frame 20 about axle 30*c* by tapping directly on one or the other end of rod 22 with a free hand. Throughout play, the object is once again to successfully land ball 46 in catcher loop 48*a* or 48*b* whenever rotating frame 20 comes to rest.

The embodiment of my invention shown in FIG. 5 permits operations of the toy in manners similar to those described for FIG. 2, with several additions. Additional catcher loops 48*c*, 48*d*, 48*e* and 48*f* permit a player to selectively toss ball 46 back and forth between various points along revolving frame 20. For example, with ball 46 resting in catcher loop 48*b*, the player can exert an upward thrust on grip 28*b*, causing ball 46 to fly up and land in either catcher loop 48*a*, 48*c*, 48*d*, 48*e* or 48*f*, depending upon the force exerted by the player. In a more challenging trick based on this embodiment, the player can manipulate the toy so that ball 46 deliberately flys off-center, wrapping around revolving frame 20 and coming to nest in the underside of one of the catcher loops 48.

Operation of the embodiment of my invention shown in FIG. 6 is similar to the operations described for FIGS. 1,2,3,4 and 5 above, with the added option that allows a player to roll ball 46 back and forth in track 52 formed by parallel rods 22*a* and 22*b* of revolving frame 20. A young child, for example, might be content simply grasping grips 28*a* and 28*b* in his or her left and right hands respectively and rolling ball 46 back and forth between the extremities of the toy. This produces a smooth, rolling sensation that contrasts with the sharp, colliding effects that characterize tricks previously described. More advanced players naturally incorporate this rolling option into more complicated tricks and routines involving the spinning of revolving frame 20 upon axles 30*a* and 30*b*. In this embodiment, the combination of tether anchor rod 38 and tether hole 40*a* serves to anchor tether 42 and ball 46 to revolving frame 20, thereby ensuring that ball 46 remains connected to the toy throughout play.

FIGS. 7,8,9 and 10 are enlarged views of some of the possible ways in which a handle mount 24 may be configured to receive a rotating handle 26. In the embodiments shown in FIGS. 7 and 8, an axle 30 with grip 28 attached can be slipped through fully-enclosed handle receiving hole 34 and then capped with a hub 32 to prevent rotating handle 26 from disengaging from rod 22 during play. In FIGS. 9 and 10, a pre-assembled or molded rotating handle 26 can be installed by pressing an axle 30 through gap 36 formed in partially-open handle receiving hole 34. In doing so, gap 36 temporarily widens to accomodate the passage of axle 30, but narrows back to its original size once axle 30 is fully seated in handle receiving hole 34, thereby preventing rotating handle 26 from detatching from rod 22 during play. In this way, rotating handles 26 can be quickly and easily installed.

SUMMARY, RAMIFICATIONS AND SCOPE

Accordingly, the reader will see that, when operated, my invention provides for a versatile tethered ball and receptacle toy incorporating a revolving frame, rotating handles, and catcher loops, that provides for a much greater variety of tricks than was possible under previous disclosures in this category. The combination of a revolving frame, rotating handles and catcher loops produces new and unanticipated physical, visual and auditory effects as a tethered ball flys, spins, collides and otherwise interacts with the various elements of the toy during play. In addition, catcher loops can nestably receive a tethered ball from both sides, thereby further increasing the variety of tricks possible using my toy. My invention also permits a wide range of players to experience a sense of success as they learn various tricks ranging in difficulty from extremely simple to extremely complicated.

Additionally, my invention anticipates variations incorporating more than two hand grips that would encourage operation of the toy by more than one person at a time, thereby enhancing playability and fostering cooperation. My invention also anticipates a variation in which a tethered ball can be rolled back and forth along a revolving frame adapted to form the shape of a track, thereby producing an effect unavailable in other toys in this category.

Lastly, my invention is relatively simple and inexpensive to produce, and permits quick assembly, which can be enhanced even more by a snap-in method for installing pre-molded, rotating handles into the revolving frame of the toy.

Although the description above contains many specificities, these should not be construed as limiting the scope of the invention but as merely providing illustrations of some of the presently preferred embodiments of this invention. For example, the rod portion or portions of a revolving frame need not be straight, but may incorporate curves and or angles along their lengths. Also, it is anticipated that any number of additional catcher loops may be added to the toy so as to increase the number of receptacles available during play. These additional catcher loops could be placed in a direct line with the catcher loops illustrated in the presently preferred embodiments, or could be placed off-center and or on different planes with those depicted herein. Additionally, numerous other configurations for the placement and number of rotating handles are anticipated; handle mounts could be placed so that rotating handles protrude from beneath the revolving frame, from the catcher loops themselves, or from anywhere on the toy that would facilitate spinning of the revolving frame in novel ways. In a simplified version of my toy, the tether depicted herein could be crafted in the form of a narrow, rigid rod or set of rods that would ensure that the ball would land in the targeted catcher loop every shot. In addition, the knots, tether anchor and tether holes used in the toy could be replaced by any number of fastening mechanisms including staples, glues, screw-eye-type anchors or one-piece, injection molded connectors.

Thus the scope of the invention should be determined by the appended claims and their legal equivalent, rather than by the examples given.

I claim:

1. Skill toy for tossing and catching a tethered ball comprising:

(a) a revolving frame including a plurality of receptacles, a plurality of handle mounts and a tether anchor;

(b) a plurality of rotating handles, each one of said rotating handles providing engaging means for engaging one of said handle mounts and rotating means for rotating said rotating handle in relation to said handle mount, whereby said revolving frame may be revolved in relation to said rotating handle when said rotating handle is held stationary by a player;

(c) a tether and a ball, one end of said tether being securely fastened to said tether anchor and an opposite end of said tether being securely fastened to said ball, whereby said ball may become selectively received at any one of said receptacles during play.

2. Skill toy in accordance with claim 1 wherein said revolving frame further includes a rod, said rod providing securing means for securing said plurality of receptacles, said plurality of handle mounts and said tether anchor to said rod.

3. Skill toy in accordance with claim 1 wherein each one of said receptacles is comprised of a substantially loop shaped catcher including an aperture of sufficient diameter to nestably receive said ball from either side of said substantially loop shaped catcher while preventing said ball from passing completely through said aperture.

4. Skill toy in accordance with claim 1 wherein each one of said rotating handles is comprised of a grip, an axle and a hub.

5. Skill toy in accordance with claim 4 wherein each one of said rotating handles further includes an additional grip constituting an extension of said hub, said additional grip providing increased gripping means for gripping said rotating handle by one or more players.

6. Skill toy in accordance with claim 1 wherein each one of said handle mounts comprises a handle receiving hole providing means for receiving and engaging one of said axles of said rotating handles.

7. Skill toy in accordance with claim 6 wherein said handle mount further includes a gap, whereby one of said rotating handles may be inserted into said handle mount in a simple snap in procedure.

8. Skill toy in accordance with claim 1 wherein said revolving frame includes a pair of parallel rods, said pair of parallel rods forming a track, whereby said tethered ball may be rolled in alternating directions upon said track by manipulating said rotating handles.

9. A game device for tossing and catching a tethered ball comprising a revolving frame including a plurality of catcher loops, a plurality of handle mounts and a tether anchor, each one of said catcher loops adapted to nestably receive a ball upon manipulation of said revolving frame, said ball being connected by means of a tether to said tether anchor, a plurality of rotating handles providing engaging means for engaging said rotating handles with said handle mounts and rotating means for rotating said rotating handles in relation to said handle mounts, whereby said revolving frame may be revolved in relation to each one of said rotating handles in order to manipulate the placement and action of said ball during play.

* * * * *